US007241071B2

(12) United States Patent
Carraher et al.

(10) Patent No.: US 7,241,071 B2
(45) Date of Patent: Jul. 10, 2007

(54) SWIVELING MULTI-CLAMP FASTENER

(75) Inventors: John Michael Carraher, Salem, OR (US); Terry Daniel Newton, Tumer, OR (US)

(73) Assignee: Jiffy Clip, Inc., Tualatin, OR (US)

( * ) Notice: Subject to any disclaimer, the term of this patent is extended or adjusted under 35 U.S.C. 154(b) by 372 days.

(21) Appl. No.: 10/851,873

(22) Filed: May 21, 2004

(65) Prior Publication Data

US 2005/0217198 A1 Oct. 6, 2005

Related U.S. Application Data

(60) Provisional application No. 60/550,703, filed on Mar. 8, 2004.

(51) Int. Cl.
*E04C 5/16* (2006.01)

(52) U.S. Cl. ..... 403/164; 403/165; 403/397; 403/400; 52/719

(58) Field of Classification Search ..... 403/386, 403/396–400; 52/719, 685, 686; 24/339
See application file for complete search history.

(56) References Cited

U.S. PATENT DOCUMENTS 3,521,332 A * 7/1970 Kramer ..... 403/188
3,913,187 A * 10/1975 Okuda ..... 24/484
4,037,978 A * 7/1977 Connelly ..... 403/164
4,096,680 A 6/1978 Ritter et al.
4,610,122 A 9/1986 De Clercq
4,688,961 A * 8/1987 Shioda et al. ..... 403/389
4,817,897 A * 4/1989 Kreusel ..... 248/68.1
5,259,690 A * 11/1993 Legge ..... 403/385
5,305,978 A * 4/1994 Current ..... 248/230.4
5,427,465 A * 6/1995 Sato ..... 403/49
5,507,460 A * 4/1996 Schneider ..... 248/225.21
D369,740 S * 5/1996 Phillips ..... D8/396
5,699,642 A 12/1997 McDevitt, Jr.
5,878,546 A * 3/1999 Westover ..... 52/719
6,503,434 B1 1/2003 Mayer

* cited by examiner

*Primary Examiner*—Daniel P. Stodola
*Assistant Examiner*—Joshua T. Kennedy
(74) *Attorney, Agent, or Firm*—Ater Wynne LLP

(57) ABSTRACT

A fastener for joining two pieces of rebar together in a rebar grid used to reinforce subsequently poured concrete is described. The fasteners include two clamp pieces that in certain embodiments completely wrap around a piece of rebar and are tightly secured thereto. Further, each clamp piece can swivel or rotate up to 360 degrees relative to the other clamp piece such that two rebar pieces intersecting at any angle can be coupled together.

12 Claims, 2 Drawing Sheets

SWIVELING MULTI-CLAMP FASTENER

REFERENCE TO RELATED APPLICATIONS

This application claims priority to and incorporates herein in its entirety the provisional application No. 60/550,703 filed on Mar. 8, 2004 entitled "Swivel Clip rebar Fastener", and having the same inventor as this application.

FIELD OF THE INVENTION

This invention generally relates to reinforced concrete, and more particularly, this invention pertains to a swiveling rebar fastener specifically adapted to secure reinforcement bars (rebar) to one another to form a reinforcement grid or structure over which concrete is subsequently poured.

BACKGROUND

Metal reinforcement is typically used in concrete when the concrete is to be used for structural purposes. The reinforcement acts to both hold the concrete together and significantly increase the strength of the resulting concrete structure. When the most common forms of metal reinforcement is rebar. In a typical process of fabricating a reinforced concrete structure, a rebar grid is fabricated at the site where the concrete is to be poured. Next, a containment form is placed around the rebar grid and concrete is poured over the rebar grid. Once the concrete is cured, the form is removed to reveal a reinforced concrete structure.

As can be appreciated, it is important that individual pieces of rebar and/or the rebar grid do not move appreciably as the concrete is poured over it. Accordingly, the various pieces of rebar comprising the grid are secured to each other to stabilize and strengthen the rebar grid so that it does not move appreciably while it is being encapsulated in concrete. Traditionally, the various pieces of rebar are secured to other pieces of rebar at their respective intersections using steel wire that is wrapped around the rebar pieces and twisted to tension it and hold it in place as shown for example in U.S. Pat. No. 4,096,680.

There are, however, several disadvantages to using steel wire. First, the wire is subject to rust especially when utilized in moist environments. This can be problematic in several ways. If there is a significant period of time between the fabrication of the rebar grid and the pouring of the concrete over the grid, the wire may rust an appreciable amount significantly reducing its strength. The weakened wire can break during the pouring of the concrete thereby permitting the rebar to shift position. Further, any rust on the wire prior to pouring and any rust that forms after pouring while in contact with moisture can leach out of the concrete and cause unsightly discoloration and staining of the resulting structure. While coating the steel wire helps mitigate the problem rust, the coatings are often fragile and can flake off during the application of the wire.

Another problem of using steel wire is that the wire can be significantly weakened as it is plastically deformed while being twisted in place. The extent to which a wire has been weakened may not be readily evidence to an installer and accordingly, the weakened wire can break during the pouring of the concrete. Conversely, if an installer fails to tighten the wire sufficiently for fear of weakening the wire, the associated rebar pieces could move unacceptably during the pouring of the concrete.

Fabricating the rebar grid using wire can be extremely labor intensive as each wire at each intersection of the rebar pieces in the grid must be manually wrapped around the intersection and twisted to hold the rebar in place. Often the amount of space between the various pieces of rebar in a grid is not significant making the process more difficult and time-consuming for an installer. The repetitive action of twisting the steel wires can cause or aggravate carpal tunnel syndrome in the installer as well.

Various solutions to the problems resulting from the use of steel wire have been proposed. U.S. Pat. Nos. 5,699,642 and 6,503,434 teach using plastic tie fasteners, which are more commonly known for use in holding cables together, to hold the rebar together. There are several issues related to the use of these plastic ties. For one, the one way clasps on these plastic ties are not very strong and can loosen or even break as the concrete is poured over the grid. The ties themselves can be relatively weak and subject to stretching as the grid structure sways and moves prior to and during concrete pouring. More stout and stronger tie straps with greater cross sectional areas are often not suitable as they are too stiff to be easily wrapped around the various rebar pieces. Further, the stiffer the strap portions of the ties are, the harder it is to adequately tension the strap by pulling it through the one way clasp member. In short, more flexible smaller plastic tie fasteners do not have adequate strength for securing the rebar pieces of a rebar grid and stouter stronger plastic tie fasteners are too stiff and difficult to work with to be routinely used.

U.S. Pat. No. 4,610,122 teaches another alternative to using steel wire to secure rebar pieces in place. The clip-type device disclosed in this patent essentially comprises to resilient open-sided cylindrical sections that are fixedly secured to each other at right angles relative to their respective longitudinal axis. Operationally, two pieces of rebar that form a 90° intersection are snapped into the respective open-sided cylindrical sections. This solution is also less than ideal. First, this device can only be used when the rebar pieces intersect at a 90° angle. Parallel pieces cannot be joined together. Pieces that intersect act acute angles cannot be joined together. Additionally, if the intersection between two pieces varies more than a few degrees off of 90° as may be expected from time to time in real world construction, an installer may not be able to properly secure the rebar pieces to the device. Second, because the cylindrical sections are opened sided, a rebar piece secured in the device could pop out of the device when subject to particular loads, such as those that can result during concrete pouring.

Another problem associated with any of the aforementioned methods of joining pieces of rebar into a grid is that the pieces of rebar are in contact with each other at the intersection. The recesses of the intersections are places where water can collect, thereby increasing the rate of corrosion and electrolysis of the rebar at that particular location. Additionally, the contact between the two pieces provides a path by which moisture can wick from one rebar piece to another even after the rebar grid has been encased in concrete.

SUMMARY OF THE INVENTION

One embodiment of the present invention comprises a rebar fastener. The fastener includes a first clamp piece that has a first clamp that is adapted to be secured around a first piece of concrete rebar and a unitarily formed opening. The fastener also includes a second clamp piece that has a second clamp that is adapted to be secured around a second piece of concrete rebar and a unitarily formed male appendage extending therefrom. The male appendage having a longitudinal axis, and is connected to the opening to permit pivotally movement of the first clamp piece relative to the second clamp piece about the longitudinal axis.

Another embodiment of the present invention also comprises a rebar fastener. The rebar fastener includes a first clamp, a second clamp and a pivotal interconnection coupling the first clamp to the second clamp. The first and second clamps are adapted to connect to first and second pieces of rebar respectively. Additionally, the first clamp can rotate 360 degrees relative to the second clamp.

Yet another embodiment comprises a method for manufacturing a reinforced concrete structure. The method includes forming a plurality of pieces of rebar into a rebar grid by coupling the various pieces of the plurality of rebar pieces together at intersections thereof of any angle using a rebar fastener. The rebar fastener comprises a first clamp and a second clamp wherein the first and second clamps are rotatably coupled to each other to permit at least 180 degrees of rotation of the first clamp relative to the second clamp. The method further includes building a mold about the rebar grid, and pouring concrete into the mold.

DETAILED DESCRIPTION

Figure 1:
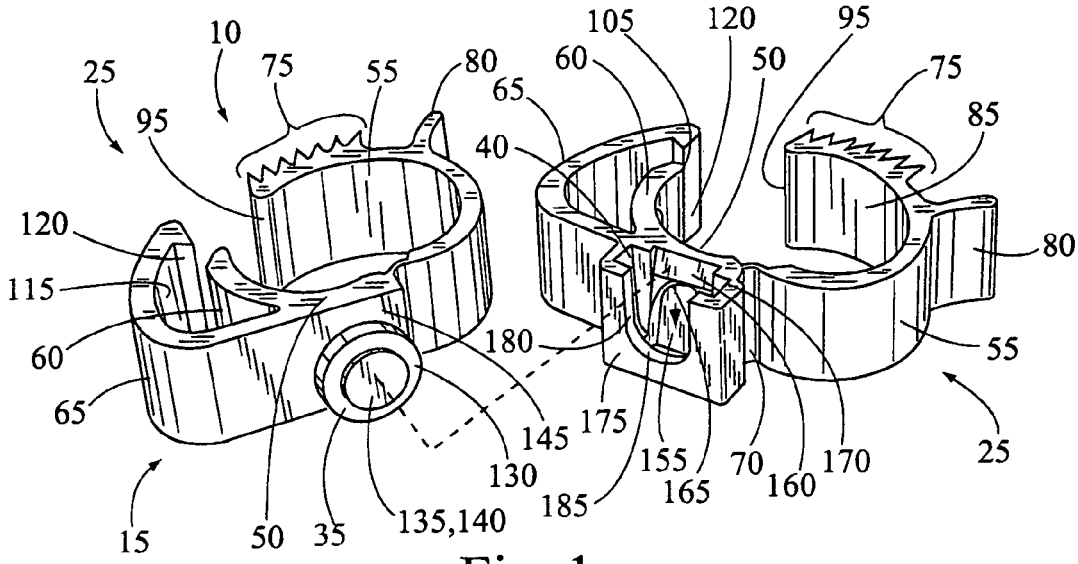
FIG. 1 is an exploded isometric view of one embodiment of the present invention with the respective clamps in their open positions.

One embodiment of the fastener of the current invention comprises a two distinct clamp pieces that are pivotally connected to each other, thereby permitting an installer to couple any two pieces of rebar at their respective intersection regardless of the angle formed between the pieces. One embodiment is preferably comprised of a plastic material thereby obviating any rust related problems common with steel wire ties. Additionally, because the fastener physically separates the pieces of rebar joined at an intersection from each other, there isn't a location for excess moisture to pool and simultaneously corrode the pieces at the intersection. Further, because the pieces of rebar are separated, there is a much smaller chance for moisture to wick from one piece to another. Additionally, if two pieces of rebar comprising different base materials are used, their will be no galvanic corrosion between them at the intersection. Another advantage of the one embodiment fastener is that the clamps wrap entirely around the rebar pieces essentially eliminating the risk of the pieces of rebar popping out of or dislodging from the fastener before or during the pouring of concrete. The configuration and stout construction of the clamp pieces and their pivoting interconnection provide a sure and tight connection with the rebar pieces and minimize the potential for the connection to loosen prior to or during the concrete pour.

In variations of the embodiment briefly described above and in other embodiments, clamp pieces having differing effective internal diameters can be joined at the pivoting connection such that rebar of differing sizes can be secured at their respective intersections. To facilitate use on a job site, the clamp pieces can be provided to an installer separately or connected together. Where a single diameter of rebar is used to form a rebar grid, an installer may find it more convenient to have the clamp pieces prejoined so that he/she may more quickly secure the rebar piece intersections. However, when the diameter of the rebar varies from piece to piece on a grid, the installer may prefer to have separate clamp pieces so they he can pivotally connect the clamp pieces together to match the differing diameters of a particular rebar pieces at an intersection. To facilitate on the site coupling of the clamp pieces to form a complete fastener, one embodiment provides for the quick, easy and secure snapping together of the respective male and female clamp pieces.

Given the foregoing examples of several possible variations and embodiments of the rebar fastener of the present invention, the advantages of the present invention, its various embodiments, and the specific embodiments illustrated and described herein are not intended to be construed as limiting. Rather, numerous variations and embodiments have been contemplated that read upon the appended claims and are intended to be within the scope of the invention.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases means that a particular feature, structure, or characteristic described in connection with the embodiment is included in at least an embodiment of the invention. The appearances of the phrase "in one embodiment" in various places in the specification are not necessarily all referring to the same embodiment.

The term "couple" or "coupled" as used in this specification and the appended claims refers to either an indirect or direct connection between the identified elements, components or objects. Often the manner of the coupling will be related specifically to the manner in which the two coupled elements interact. For example, a piece of rebar can be mechanically coupled to another piece of rebar even if the clamps are not physically touching but are attached to one or more intervening elements such as a rebar fastener.

The terms "section" and "portion" and "piece" are used repeatedly herein and are not intended to have any specific meanings in and of themselves other than to refer to elements of the invention as specifically indicated herein.

The terms "apparatus" and "device" are used interchangeably herein unless specifically indicated otherwise.

The terms "clasp", "clip" and "clamp" are used interchangeably herein unless specifically indicated otherwise.

The term "rebar" as used herein is not limited to reinforcing bars made of steel or iron, but also refers to reinforcing bars made of other materials such as but not limited to other metals, plastics and composites.

One Embodiment of the Rebar Fastener And Use Thereof

Figure 2:
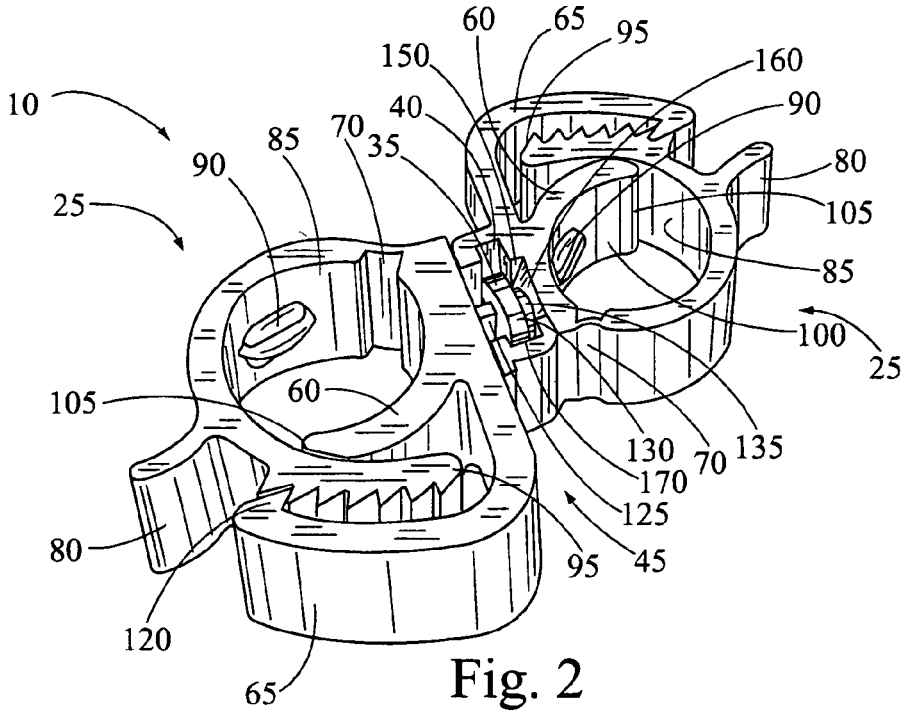
FIG. 2 is an isometric view of one embodiment of the present invention with the respective clamp sections joined together and the clamps in their closed positions.
Figure 3:
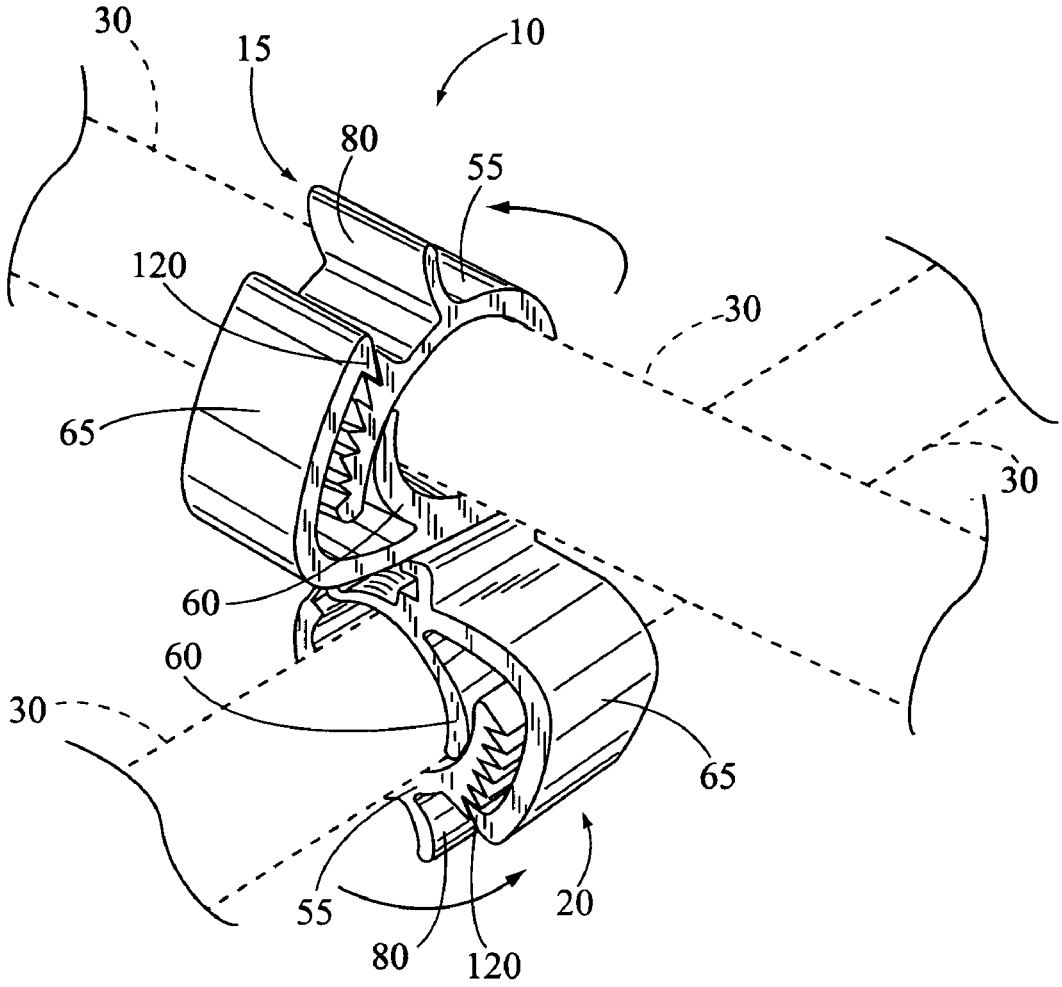
FIG. 3 is an isometric view showing the rebar fastener securing two pieces of rebar together at a approximately right angle.

One embodiment of the rebar fastener 10 is illustrated in FIGS. 1–3. Simply, the fastener comprises two clamp pieces 15 & 20 that each includes a clamp (or clasp) section 25 for being secured around a piece of rebar 30. One clamp piece also includes a male appendage 35 integrally molded with the clamp section. The other clamp piece includes a corresponding opening 40 into which the male appendage is pivotally and securely received to form a swivel 45, whereby the respective clamp pieces are free to rotate up to 360 degrees relative to the other clamp piece. Accordingly, the rebar fastener can be used to couple and secure two pieces of intersecting rebar together no matter what the angle of their intersection.

The clamp pieces 15 & 20 are preferably comprised of injection molded polyethylene although they can be fabricated from other polymeric materials or cast from a suitable metallic material. Other fabrication methods can also be used to produce the respective clamp pieces such as extrusion with some post extrusion machining as required.

As stated above, the male appendage 35 in one clip piece and the corresponding opening 40 in the other clamp piece, which together to form the functional swivel 45 of the fastener 10, are preferably integrally molded with the respective clamp pieces. The specific configuration of the male appendage and the opening, as well as, their swivel functionality is described in greater detail below. However, in alternative embodiments the swivel can comprise a separate element such as, but not limited to, a metal or plastic rivet or bolt that joins two clamp pieces together via suitable bores in the respective clamp pieces.

Referring primarily to FIG. 1, the clamps 25 of each clamp piece, which share a common structure and configuration, are described. Each clamp includes a base section 50. Depending on the respective clamp piece 15 & 20, the male appendage 35 extends from the base section or an opening 40 is molded on and into the base section. From opposite sides of the base section, generally arcuate arms 55, 60 & 65 extend therefrom. A long arm 55 is connected to the base section at its proximal end by an integrally molded living hinge 70 permitting it to pivot inwardly and outwardly relative to the base section. Proximate and terminating at the distal end 95 of the longer arm, the outer circumferential surface of the long arm forms an undulating section 75 that comprises a plurality of alternating valleys (indents) and teeth. Also a thumb (or finger) plate 80 radiates outwardly from the outer circumferential surface of the long arm a short distance from the undulating section 75. As will be described below, the thumb plate facilitates the attachment of the associated clamp 25 around a piece of rebar 30.

Typically, the inside surface 85 of the long arm between a location proximate the thumb plate 80 and the living hinge 70 has a radius of curvature only slightly larger than the radius of the size rebar it is configured to securely clamp around. A circumferentially orientated small roughly rectangular-shaped protrusion 90 extends inwardly from this section of the long arm's inside surface. It is sized to nest against a piece of rebar and thereby more securely hold the clamp in place. The radius of curvature of inside surface 85 of the long arm from the location proximate the thumb plate and the distal end 95 is significantly greater than that of the radius of the rebar around which the clamp is configured to be secured.

A short arm 60 extends from the base section 50 along a side thereof that is opposite the long arm 55. The inside surface 100 of the small arm has a radius of curvature only slightly larger than the radius of the size rebar 30 it is configured to securely clamp around. A small roughly rectangular-shaped protrusion 90 similar to that of the long arm also extends inwardly from the small arm's inside surface. The outside surface of the small arm is tapered proximate its distal end 105 to facilitate slidable contact with the inside surface 85 of the long arm when the clamp is closed around a piece of rebar.

Finally, a latch arm 65 extends outwardly from the base section 50 along the same side as the short arm 60. The latch arm first extends straight from the base section and than curves inwardly such that the distal end 110 of the latch arm is located above and spaced a short distance from the distal end 100 of the short arm. At the distal end on the inside surface 115 of the latch arm a single tooth 120 projects inwardly towards the tapered outside surface of the short arm 60 proximate its distal end 105. Importantly, the normal spacing between the peak of the tooth 120 and the adjacent tapered portion of the short arm is approximately the same as the thickness of the long arm 55 measured between a bottom of a valley of the undulating section 75 and the long arm's inside surface 85.

To secure the clamp 25 around a piece of rebar 30, an installer pulls the distal end 95 of the long arm 55 away from the distal end 105 of the short arm 60 by pivoting the long arm about the living hinge 70 until the distance therebetween is sufficient to slide the piece of rebar into the clamp. After the rebar is slid into the clamp, the installer pushes the distal end of the long arm in-between the distal ends of the short and latch arms 60 & 65. As the long arm is pushed, the latch arm flexes outwardly and applies a bias inwardly against the long arm. Accordingly, the tooth 120 of the latch arm is snappily received into the valleys (indents) of the undulating section 75. The installer continues to push the long arm into the gap between the distal ends of the short and latch arms until the clamp is securely tightened around the piece of rebar as indicated in FIG. 3. Additionally, FIG. 2 illustrates the clamps of the fastener in their closed position sans the rebar. The nesting of the latch arm tooth in a corresponding valley of the long arm's undulating section prevents the long arm from pivoting outwardly. Further, the bottom surface of the long arm radially beneath the corresponding valley is prevented from flexing inwardly as it rests upon the tapered outside surface of the short arm at the short arm's distal end 105. Accordingly, the clamp is firmly secured around the associated piece of rebar.

Referring specifically to FIG. 2, the respective inside radii of curvature for the long and short arms 55 & 60 of each clamp 25 differ from that of the opposing clamp 25 to which it is swivelly connected. It is to be appreciated that there are numerous standard sizes of rebar from 0.375" in diameter up to 1.693" in diameter. To accommodate the different sizes, clamps of different sizes can be used. Generally, however, each clamp of a particular size will work on two different sizes of rebar. For example, one size clamp with securely attach to both 0.50" and 0.625" diameter rebar pieces. Preferably, the male appendages 35 and associated openings 40 that comprise the swivel mechanism 45 are of a standard size regardless of the size of the particular clamp, thereby an installer can snap two clamps of different sizes together to facilitate the connection of two different sizes of rebar.

As indicated above, the male appendage 25 of one clamp piece 15 and a corresponding opening 40 of another clamp piece 20 interlock together as to form the swivel 45 or pivotal connection between the two clamp pieces that permits the clamp pieces to be rotated up to 360 degrees relative to each other. Referring primarily to FIG. 1, the male appendage comprises a columnar portion 125 that extends generally perpendicularly from a bottom surface 145 of the clamp piece's base section 50. As illustrated, the columnar portion has a cross section resembling a plus sign. However, the columnar portion can be of any suitable shape such a fully cylindrical. It is to be appreciated that the cross section of the illustrated embodiment provides the necessary support and functionality but requires less plastic material than a fully cylindrical columnar portion thereby resulting in a lower material expense. A disk portion 130 sharing the same center axis as the columnar portion is formed on top of the first columnar member's distal end. The disk portion has a diameter significantly greater than the cross sectional dimension of the columnar portion. Extending from the distal surface of the disk portion is a cylindrical button portion 135 that has shares the same center axis as the columnar and disk portions. As illustrated, the button portion has a diameter that is smaller than the diameter of the disk portion or the cross sectional dimension of the columnar portion. In variations and alternative embodiments, these relative dimensions can vary as appropriate. The distal end 140 of the button portion is also the distal end of the male appendage and comprises a flat surface that is generally parallel with the bottom side of the base section.

The corresponding opening 40 in the other clamp piece 20 of the rebar fastener 10 primarily comprises a slot into which the male appendage 35 is securely received. The proximal end of the opening comprises a bottom slot portion 150 that has a width slightly greater than the diameter of the button portion 135 that is received therein. The bottom surface 155 of the bottom slot portion, which also is the bottom surface of this clamp piece's base section 50, interfaces with the bottom surface 145 of the button portion when the respective clamp pieces are assembled. Proximate the side opening of the bottom slot portion, the bottom surface includes an upwardly ramping portion 160 that terminates in a rearwardly facing arcuate wall 165. The arcuate wall has a radius of curvature somewhat greater than the radius of the corresponding button portion of the male appendage. When the male appendage is fully received into the opening the rearwardly facing arcuate wall interfaces with the circumferential sidewall of the button portion to prevent the male appendage from sliding out of the open side of the slotted opening as will become more apparent in the further description provided below.

Above the bottom portion of the slot is a wider middle slot portion 170. The width of the middle slot portion is essentially the same as (or slightly greater than) the diameter of the disk portion 130 of the male appendage, which is received therein. The height of the middle slot portion is essentially the same height as (or slightly greater than) the thickness of the disk portion of the mail appendage. Accordingly, the close fit of the disk portion within the middle slot portion minimizes the free play between the two clamp pieces 15 & 20 when they are joined.

Above the middle slot portion is a top end wall 175 with a top slotted portion 180 formed therein. The top slotted portion includes an arcuate back edge 185 against which the first columnar portion 125 of the male appendage 35 rests when the two clamp pieces are joined. Accordingly, this back edge prevents the male appendage from sliding out of the opening 40 rearwardly.

To join the two corresponding clamp pieces 15 & 20, an installer slides the male appendage 35 of the one clamp piece 15 into the opening 40 in the other clamp piece 20. The ramping portion 160 of the bottom slot portion 150 and the button portion 135 of the male appendage resiliently deform slightly with the application of pressure to permit the male appendage to fully slide into place. Once the button portion of the male appendage has slid past the ramping portion, the ramping portion and the button portion resiliently snap back to their normal dimensions, such that the bottom surface 140 of the button portion is located below the top edge of the arcuate wall 165 of the ramping portion. Accordingly, the male appendage cannot slide outwardly of the opening. Further, because of the arcuate back edge 185 of the top slot portion 180, the male appendage cannot be slid through and out of the other side of the opening. Finally, because of the relatively snug fit of the disk portion 130 in the middle slot portion 170, there is very little play between the joined clamp pieces such that an installer cannot pull the bottom surface 145 of the button portion above the top edge of the arcuate edge of the ramping portion by attempting to pull the two clamp pieces apart. In other words, once the two clamp pieces are joined together, they cannot be easily separated without potentially damaging the rebar fastener 10.

FIG. 2 shows two clamp pieces 15 & 20 joined together to form a rebar fastener 10 for joining to different sizes of rebar 30 together. Of particular note is the fact that the bottom surface of the base section 50 on the clamp piece 15 including the male appendage 35 is in close contact with the top surface of the top end wall 175 of the structure of the other clamp piece 20 that includes the corresponding opening 40. Because of the intimate contact between the clamp pieces, as well as, the relatively tight fit of the male appendage in the opening, the two clamp pieces will hold in the pivotal position in which they are placed. In other words, the frictional contact between the two clamp pieces and their respective male appendage and corresponding opening prevents the two clamp pieces from freely pivoting relative to each other unless intentionally rotated or pivoted by an installer. Accordingly, the installer can orientate the clamp relative to the approximate angle of intersection of two crossing rebar pieces prior to installing the rebar fastener thereto.

Operationally, when building a rebar grid to be subsequently reinforced with concrete, an installer first determines what size clamps 25 are to be utilized and whether the rebar pieces 30 to be joined are of the same or differing sizes. If all or most of the pieces of rebar are to be the same size for a particular grid, the installer may choose to snap together a number of clamp pieces 15 & 20 to form complete rebar fasteners 10 or he/she may decide to use preassembled rebar fasteners. If a variety of different size pieces of rebar are to be joined, he/she might bring several different sizes of clamp pieces 15 & 20 to the work site to be manually joined into a fastener 10 as required to match the differently-sized rebar pieces. Next, the installer then places the pieces of rebar into position on the grid. The installer may place one clamp 25 around one of the pieces of rebar 30 first by (i) first pulling the arms 55, 60 & 65 of the clamp apart, (ii) placing the clamp around the first piece of rebar, and (iii) tightening and locking the clamp in place by pushing the long arm 55 of the clamp in-between the short arm 60 and the latch arm 65 securing the latch tooth 120 into one of the valleys (or indents) in the undulating section 75 of the long arm. Next, the installer (i) orientates the other clamp piece relative to the desired angle of intersection of the associated pieces of rebar if he/she hadn't already done so, (ii) places the other clamp over the second piece, and (iii) tightens the clamp in place. It is to be appreciated that in addition to helping prevent the clamp pieces from sliding on the rebar, the rectangular protrusions 90 on inside surfaces of the short and long arms also compress resiliently and plastically when tightened to help hold the clamp tightly in place.

Other Embodiments and Other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For example, in one or more variations the two clamp pieces can be held together with a separate rivet or plastic brad piece rather than having a male appendage integrally molded into one of the clamp pieces. The clamps themselves can differ even significantly from those illustrated. For instance, they can comprise clips with partially open sides that simply snap over the rebar. The clamps can also be made of other materials, such as steel or stainless steel and can be configured similarly to an endless clamp. In yet other variations, indents can be provided on the swivel portion of the fastener to indicate and hold the clamps at certain commonly used angles relative to each other. It is further appreciated the method of using the rebar fastener as described herein is merely exemplary and that the sequence of operations relative to installing the clamps on rebar can also vary substantially.

It is to be further appreciated that a fastener of substantially similar design to the fastener described herein and claimed below can also be utilized in other applications where it is desirable to connect two or more tubes, rod or bars at an intersection, or where it is desirable to ensure that the tubes rods or bars do not physically come into actual contact with each other to minimize the risk or electrolysis and/or corrosion. For instance, the fasteners could be used in applications relating to heating and cooling and plumbing.

We claim:

1. A fastener comprising:

a first integrally formed clamp including, a base portion having a female receptacle configured to receive a reciprocal male member and to secure a button portion of the male member in a snap fit engagement with an arcuate wall of the female receptacle, the first arcuate arm pivotally coupled at a proximal end with the base portion by a living hinge, and having at least one elevated ridge at a distal end, the second arcuate arm coupled at a proximal end with the base portion in a cantilevered configuration, and having at least one elevated ridge at a distal end, the at least one elevated ridge of the second arcuate arm configured to enable an interlocking interaction with the at least one elevated ridge of the first arcuate arm;

a second integrally formed clamp including, a base portion having a projecting male member, the male member having a first portion proximate the base portion that is narrower than a distal second portion and also having a cylindrical button portion extending distally from the second portion, the first arcuate arm pivotally coupled at a proximal end with the base portion by a living hinge, and having at least one elevated ridge at a distal end, the second arcuate arm coupled at a proximal end with the base portion in a cantilevered configuration, and having at least one elevated ridge at a distal end, the at least one elevated ridge of the second arcuate arm configured to enable an interlocking interaction with the at least one elevated ridge of the first arcuate arm, the first and second arcuate arms curving relatively inward toward one another; and a rotatable interconnection coupling the female receptacle of the first clamp to the male member of the second clamp wherein the first clamp can rotate 360 degrees relative to the second clamp.

2. The fastener of claim 1, wherein the normal diameter of the first clamp when fully closed is similar to the diameter of one of a group of #10, #13, #16, #19, #22, #25, #29, #32, #36, and #43 soft metric-sized rebar and the second clamp when fully closed is similar to one diameter of a soft metric-sized rebar of the group other than the diameter similar to the first clamp when closed.

3. The fastener of claim 1, wherein the first clamp is adapted to fully circumferentially encircle an elongate member.

4. The fastener of claim 1, further comprising a third arcuate arm intermediate the first arm and the second arm and coupled with the base portion at a proximate end, the third arm curving relatively inwardly toward the first arm, a sufficiently large separation existing between the second arm and the third arm to receive the distal end of the first arm when the first arm is pivoted inwardly upon the living hinge toward the second arm.

5. The fastener of claim 1, wherein the diameter of the button portion is less than the diameter of the second portion.

6. The fastener of claim 1, wherein the female receptacle comprises a slot and includes a ramping portion, the ramping portion being located on one end of the slot and terminating in the arcuate wall.

7. The fastener of claim 1, wherein the first clamp cannot be separated from the second clamp without damaging one or both of the first and second clamps once the first and second clamps have been joined together.

8. The fastener of claim 1, wherein the first and second clamps are comprised of a polymeric material.

9. The fastener of claim 1, further comprising a protrusion coupled with and extending inwardly relative to the arcuate curvature of at least one of the first arm or the third arm of at least one of the first clamp and the second clamp.

10. The fastener of claim 1, wherein a portion of at least one of the first integrally formed clamp or the second integrally formed clamp includes at least one indent configured to maintain a rotational orientation of the first clamp relative to the second clamp.

11. The fastener of claim 1, wherein a portion of the first integrally formed clamp is configured to firmly contact a portion of the second integrally formed clamp and frictionally maintain a rotational orientation of the first clamp relative to the second clamp.

12. The Fastener of claim 1, wherein the effective diameter of the first clamp when closed is significantly greater than the effective diameter of the second clamp when closed.

* * * * *